United States Patent [19]

Murakami et al.

[11] 4,026,089

[45] May 31, 1977

[54] DEVICE FOR SETTING OPERATION POSITION OF CRIMPING HOOK IN COIN WRAPPING MACHINE

[75] Inventors: Yasuo Murakami; Hirokuni Matono, both of Himeji, Japan

[73] Assignee: Glory Kogyo Kabushiki Kaisha, Himeji, Japan

[22] Filed: Sept. 29, 1976

[21] Appl. No.: 727,867

[30] Foreign Application Priority Data

Sept. 30, 1975 Japan ..... 50-118128

[52] U.S. Cl. ..... 53/77; 53/212

[51] Int. Cl.² ..... B65B 57/02; B65B 11/04

[58] Field of Search ..... 53/77, 212

[56] References Cited

UNITED STATES PATENTS

| | | | |
|---|---|---|---|
| 3,899,864 | 8/1975 | Uchida et al. | 53/112 |
| 3,905,176 | 9/1975 | Ushio | 53/212 |

*Primary Examiner*—Travis S. McGehee

*Attorney, Agent, or Firm*—Wenderoth, Lind & Ponack

[57] ABSTRACT

When a selected loading platform bearing a roll of wrapping paper of a width corresponding to stack of a selected kind of coins to be wrapped is brought into a paper feeding station in a coin wrapping machine, a detection member is actuated in conformance with that paper width thereby to adjustably set the operational position of at least one of two crimping hooks in a device for fold crimping the outwardly projecting lateral edges of the paper after it has been wrapped around the coin stack.

1 Claim, 4 Drawing Figures

DEVICE FOR SETTING OPERATION POSITION OF CRIMPING HOOK IN COIN WRAPPING MACHINE

BACKGROUND OF THE INVENTION

This invention relates generally to coin packaging or wrapping apparatuses and more particularly to coin wrapping machines of the type wherein, in each operational cycle, a piece of wrapping paper is wrapped around the cylindrical surface of a stack of a specific number of coins supported by coin supporting means, and the lateral edges of the paper intentionally caused to project outwardly beyond the two ends of the coin stack are fold crimped inward by crimping hooks thereby to form a rigidly packaged coin stack.

More specifically, the invention relates to a crimping hook position adjusting and setting device for setting the position of the above mentioned crimping hooks in conformance with the width of the wrapping paper in a coin wrapping machine.

In general, in a coin wrapping machine of the character referred to above, in which the wrapping paper is the form of a long ribbon, there are instances where the total lengths of the coin stacks differ because of difference in the number of coins wrapped or because, even if the number of wrapped coins is the same, the coin thickness differs with the denomination or kind of coin. In such cases, it is necessary to change the wrapping paper to one having width suited for the total length of the coin stacks to be wrapped. When the wrapping paper is thus changed for one of different width, the positions of the crimping hooks must be adjusted beforehand to those suitable for fold crimping the edges of the wrapping paper wrapped around the coin stack.

In a coin wrapping machine known heretofore, however, devices such a coin sorting passage and a coin stacking cylinder for stacking and aligning a specific number of coins in each operational cycles are mechanically intercoupled with means for controlling settings so as to adjustably set these devices simultaneously to suit the packaging of the coins to be packaged. For this reason, the resistance to turning of the knob or lever of the setting control means becomes very high.

SUMMARY OF THE INVENTION

It is an object of this invention to provide, in a coin wrapping machine of the above described character, in which, when a wrapping paper roll loading platform bearing a roll of wrapping paper of a width corresponding to a stack of a selected kind of coins to be wrapped is brought selectively into a paper feeding position, a detection member is actuated in conformance with that paper width thereby to adjustably set the operational position of at least one of two crimping hooks in the wrapping paper edge fold crimping device of the coin wrapping machine.

The nature, principles, and utility of this invention will be more clearly apparent from the following detailed description with respect to a preferred embodiment of the invention when read in conjunction with the accompanying drawings briefly described below, in which like parts are designated by like reference numerals.

DETAILED DESCRIPTION

Figure 1:
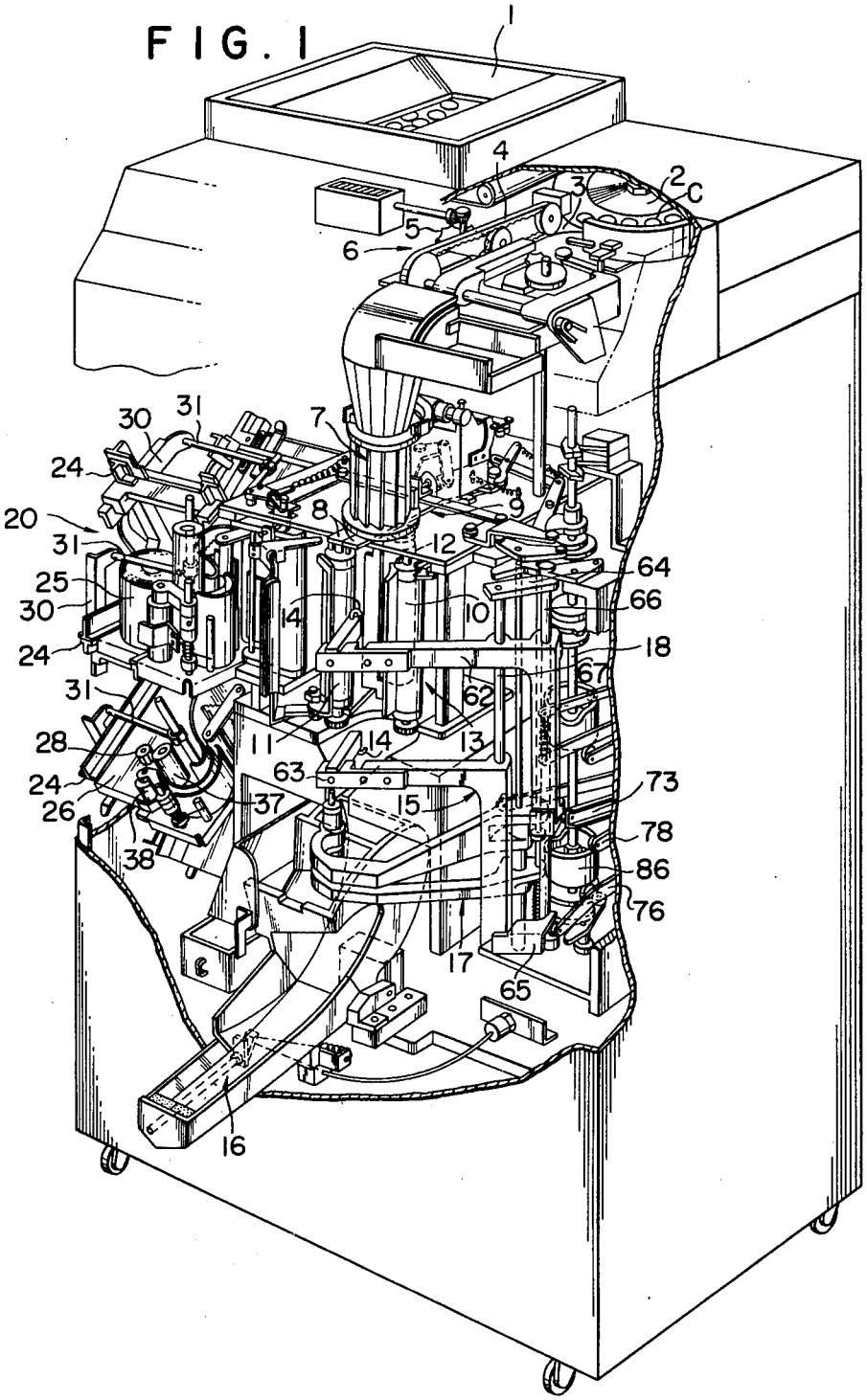
FIG. 1 is a perspective view, with parts cut away, showing one example of a coin packaging or wrapping machine in which the crimping hook adjusting device according to this invention is applied.

As conducive to a full understanding of this invention, the general features of one example of a coin wrapping machine, in which the device of this invention is applied, will be first described with reference to FIG. 1.

This coin wrapping machine comprises, essentially a coin feeding device 6, a coin aligning and stacking cylinder 7, a shutter mechanism 9, a coin wrapping device 13, a wrapping paper fold crimping device 15, and a stacked coin supporting device 17, all of these devices being driven with respective timing determined by cams, gears, or like means on a cam shaft 18 of a driving system.

The above mentioned coin feeding device 6 has a hopper 1 into which coins C of any selected one kind to be wrapped are dropped, and from which these coins drop further onto a rotating turntable 2. The coins are thereby moved by centrifugal force to the outer periphery of the turntable 2, from which they are led out by a guide member 3 to a coin passage, along which the coins are propelled in single file by a coin propelling device 4. The coins are then counted by a counting mechanism 5. The coin feeding device 6 thus feeds a batch of a predetermined number of coins in each operational cycle to the coin aligning and stacking cylinder 7.

The coin stacking cylinder 7 thereupon operates to align these coins into the state of a vertical stack, which momentarilly rests on shutter plates 8, 8 of a shutter mechanism 9 provided at the bottom of the coin stacking cylinder 7 to open and close the bottom end thereof. When all of the coins in the batch have been thus stacked, the shutter mechanism 9 opens to permit the coin stack to descend into the coin wrapping device 13.

The principal parts of the coin wrapping device 13 are a plurality of wrapping rollers 10, 11, and 12 disposed vertically at spaced-apart positions to receive the coin stack therebetween in sliding contact and impart rotation to the coin stack and to wrap a piece of wrapping paper cut to a specific length around the cylindrical surface of the coin stack. The above mentioned wrapping paper fold crimping device 15, which is a part of the coin wrapping device 13, has upper and lower crimping hooks 14, 14 for fold crimping inward the outwardly projecting lateral edges of the wrapping paper thus wrapped around the coin stack. During the coin stack wrapping and edge crimping operations, the coin stack is supported by the stacked coin supporting device 17 operating to lower the coin stack into the coin wrapping device 13, to hold the stack in the space between the wrapping rollers 10, 11, and 12 during the wrapping step, and, upon completion of the wrapping step, to retract downward thereby to lower the wrapped coin stack into a dispensing chute 16.

In the instant illustrated example, the width of the wrapping paper is so selected that the distance by which the lower edge part of the wrapping paper wrapped around the coins supported in stacked state projects downward beyond the lower end of the coin stack is made constant irrespective of the kind of coins being wrapped, while the distance by which the upper edge part of the wrapping paper projects upward beyond the upper end of the coin stack is substantially equal to the above mention distance of downward projection.

Figure 2:
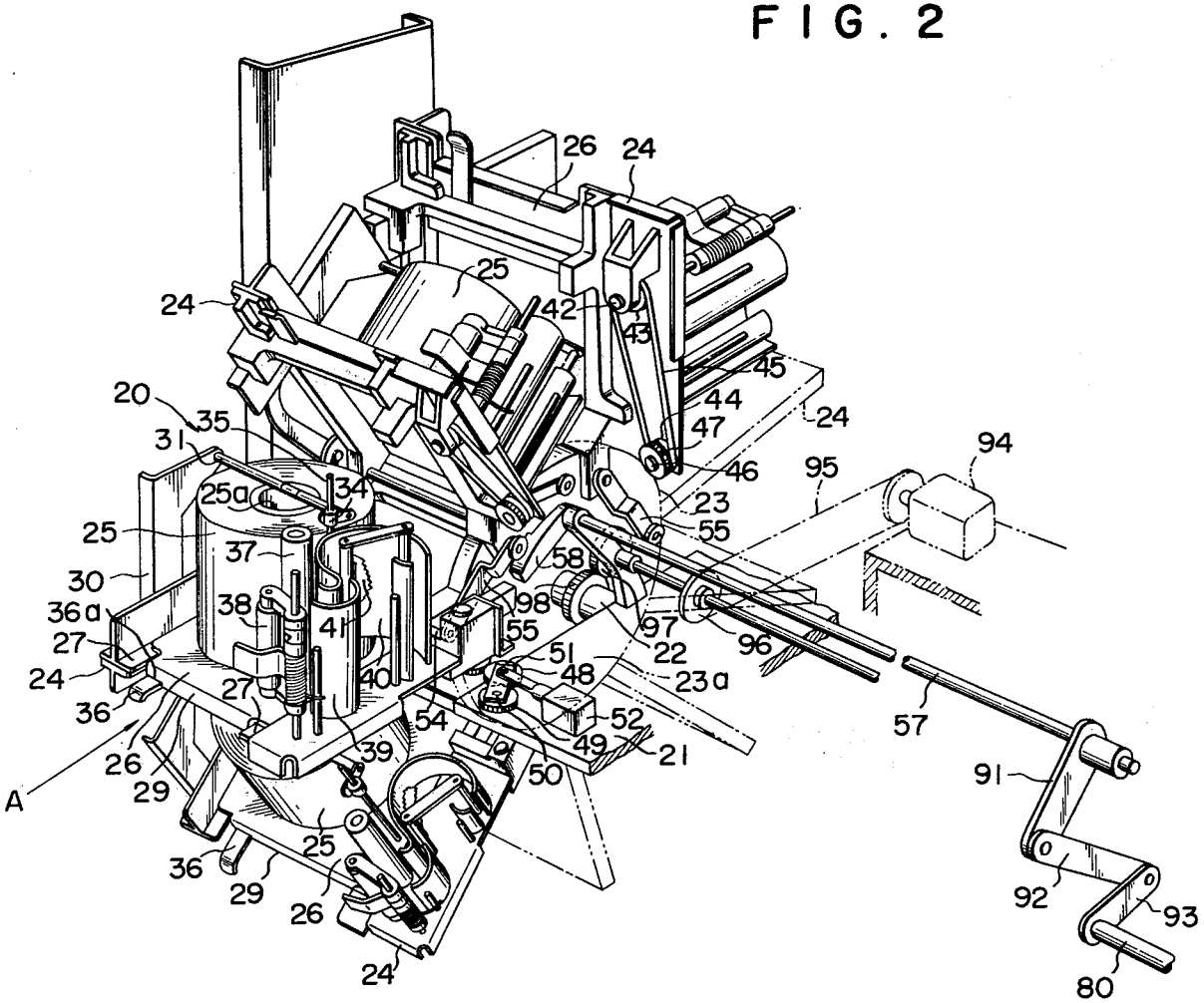
FIG. 2 is a relatively enlarged perspective view showing one example of a crimping hook adjusting device of the invention.

Next, a wrapping paper storage device 20 related directly to this invention will be described with reference to FIG. 2. On a structural part 21 of the machine body, a rotating shaft 22 is rotatably mounted in a horizontal direction. A rotating structure 23 is fixed to this rotating shaft 22 to rotate unitarily therewith and has flanges 23*a*, 23*a* on which the base parts of a plurality of wrapping paper roll loading platforms 24, 24, . . . are mounted in radial directions with respect to the axis of the shaft 22. A loading plate 26 on which a roll 25 of wrapping paper is loaded in upright attitude is slidably mounted on each loading platform 24 and can therefore be drawn out from the outer end in the radial direction of the platform 24 and pushed back in the manner of a drawer. More specifically, each loading platform 24 has rail parts 27, 27 on left and right sides thereof, and grooves (not shown) formed on opposite sides of the corresponding loading plate 26 fit onto these rail parts 27, 27, whereby the loading plate 26 is freely slidable on the rail parts 27, 27.

Each loading plate 26 is provided at substantially the center thereof with an upright support spindle 28 for supporting a wrapping paper roll 25, which is fitted at its central hole 25*a* onto the spindle 28. Each loading plate 26 is also provided at its outer end with a hand drawing flange 29.

Figure 3:
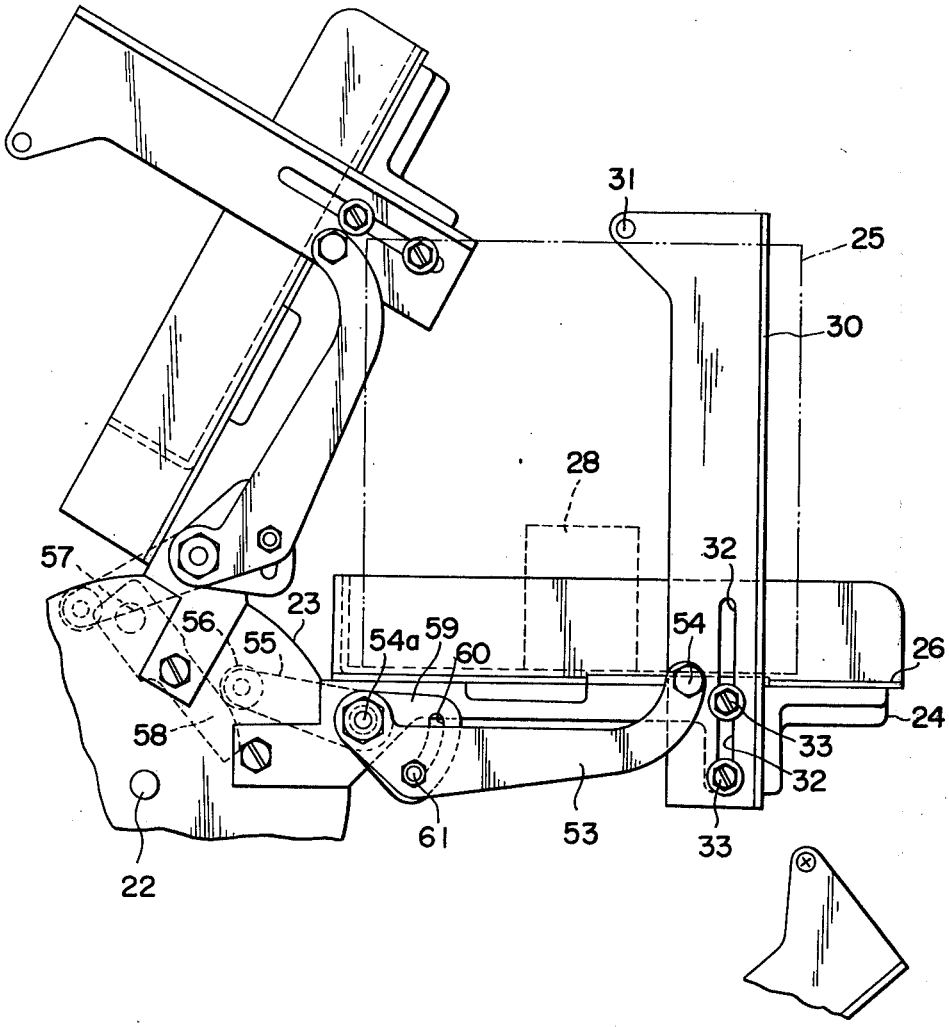
FIG. 3 is a further enlarged elevation showing essential parts of the device illustrated in FIG. 2.

The width of the wrapping paper is detected by a detection mechanism provided on each loading platform 24 and comprising an upright column 30 mounted in a height-adjustable manner on one side of the loading platform 24 and a holding member 31 secured at its one end to the upper end part of the column 30 and extending in a direction to traverse over the support spindle 28 of the loading plate 26 as shown in FIG. 3. The height of the column 30 can be adjusted and set by lock screws 33, 33 inserted through a longitudinal slot 32 in the column 30 and screwed into the loading platform 24. A bearing cylinder 34 is fixed to the other end of the holding member 31. One end of a guide column 35 provided on the other side of the loading platform 24 is fitted through the bearing cylinder 34, whereby the holding member 31 is stably supported.

A lock lever 36 for locking each loading plate 26 at a specific position is provided at the outer end part of the corresponding loading platform 24. This lock lever 36 has a stepped part 36*a* by which the lock lever 36 is disengaged, upon being pressed downward, from the outer end of the loading plate 26 and is held in engagement therewith upon being released.

On the upper surface of each loading platform 24 on the side thereof nearest the coin wrapping device 13, there is provided a wrapping paper feeding device comprising: a pair of paper feeding rolls 37 and 38 for clamping therebetween wrapping paper from the paper roll 25 and paying out the same; guide plates 39 and 40 having curved shapes adapted to guide the wrapping paper thus paid out as slack is imparted thereto; and a cutter 41 having a Vee-shaped cutting edge directed toward the feeding path of the wrapping paper and operating to cut the wrapping paper when the paper is pressed against its cutting edge as a result of tension applied to the paper when its leading part is caught between the wrapping rollers 10, 11, and 12 in the coin wrapping device 13 and thus pulled.

Of the above mentioned paper feeding rolls 37 and 38, the roll 37 is a driving roll and has a lower end extending below the loading platform 24 and having a projecting shaft 42 on which a pulley 43 is secured. This pulley 43 is coupled by an endless belt 45 to a pulley 44 for rotation transmission provided on the lower face of the loading platform 24 on the side thereof nearest the structural part 21 of the machine body. The pulley 44 is fixed to a rotating shaft 46 which is rotatably supported by the loading platform 24, and to which a driven gear 47 is also fixed. This gear 47 is adapted to mesh with an idler gear 48 provided on the structural part 21 when the relevant loading platform 24 is brought into position for feeding wrapping paper to the coin wrapping device 13.

The idler gear 48 is meshed with a driving gear 49 and is rotatably supported on one end of a lever 51 pivoted at its other end on the shaft of the driving gear 49. The lever 51 is coupled to the outer end of the actuator rod of a solenoid 52, which is operated to advance the idler gear 48 to a position where it can mesh with the gear 47 of a selected loading platform 24.

In connection with the aforedescribed mechanism for mechanism for detecting wrapping paper width in each loading platform 24, an arm 53 is pin connected at its one end by a pin 54 to the lower end part of the support column 30 secured in upright state to the loading platform 24 and is rotatably connected at its other end by a shaft 54*a* to the structural part 21. A detection member 55 is secured to this shaft 54*a* in a manner to extend in the direction of the rotating shaft 22, and the position of the extreme end of the detection member 55 is varied in accordance with the swinging movement of the above mentioned arm 53.

A roller 56 is rotatably supported on the extreme end of the detection member 55 and is arranged so that it can contact one side face of a driven arm 58 secured to the end of a setting transmission shaft 57 for setting the positions of the crimping hooks 14, 14. A fine adjustment mechanism is provided at the coupling part between the above mentioned arm 53 and the detection member 55 as shown in FIG. 3. This mechanism comprises a sector-shaped lever part 59 formed integrally with the detection member 55 and having an arcuate slot 60 with a center of curvature coinciding with the centerline of the shaft 54*a* and a lock screw 61 passed through the arcuate slot 60 and a hole in the arm 53. By means of this mechanism, the relative angular positions of the arm 53 and the detection member 55 can be selected and fixed thereby to achieve fine adjustment.

The wrapping paper fold crimping device 15 and the above mentioned crimping hooks 14, 14 are set by a setting mechanism including the above mentioned control transmitting shaft 57 in the following manner. Referring again to FIG. 1, this setting mechanism has an upper arm 62 for supporting the upper crimping hook and a lower arm 63 for supporting the lower crimping hook. These arms 62 and 63 have end parts which are bent toward the coin wrapping device 13 and support at their extreme ends respective crimping hooks 14, 14. The upper and lower crimping hooks 14, 14 are of substantially U-shape with outer tips directed toward each other in coaxial alignment.

Figure 4:
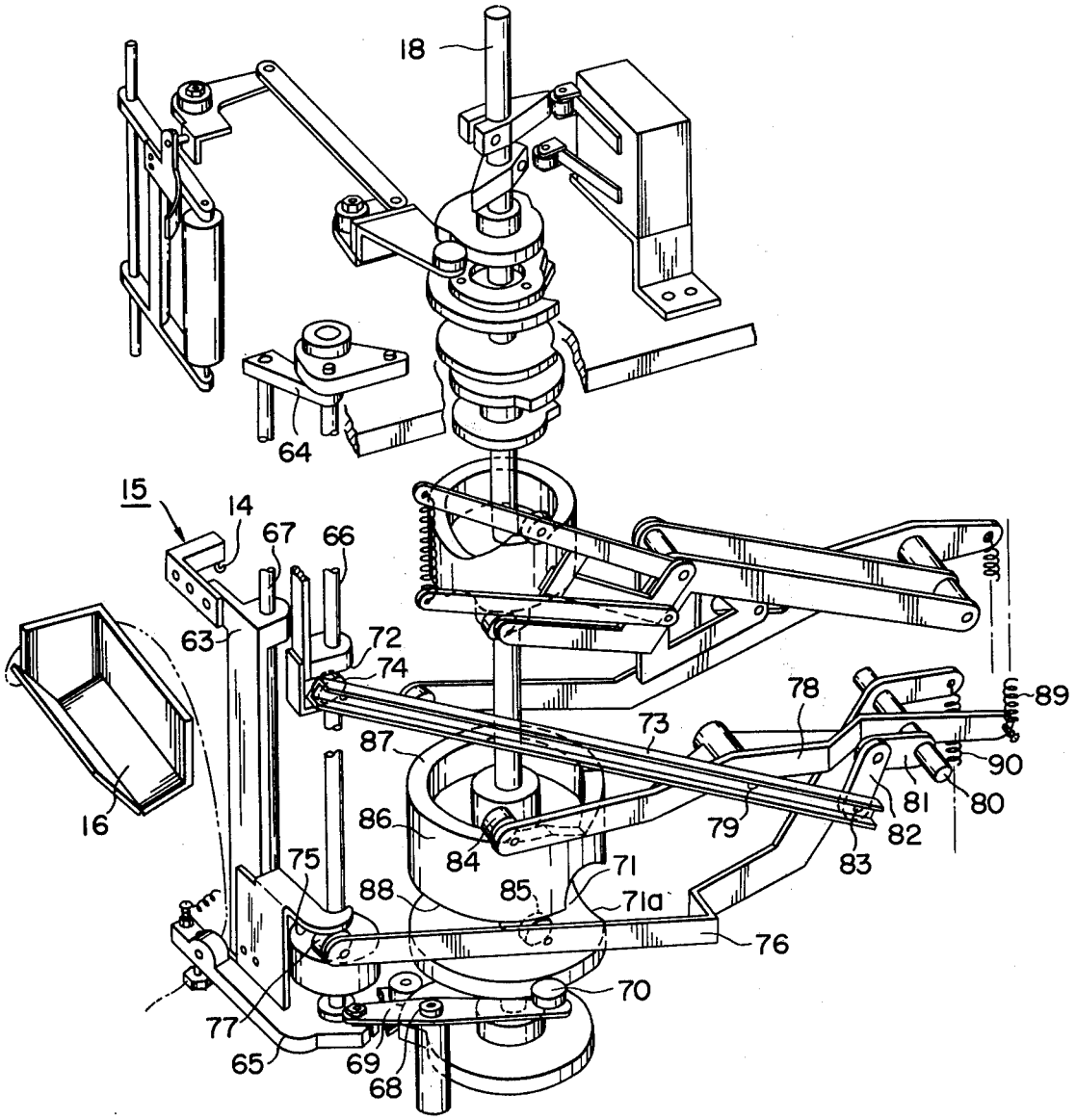
FIG. 4 is a relatively enlarged perspective view, with some parts truncated, showing one example of a crimping hook setting mechanism.

The upper and lower arms 62 and 63 are supported at their respective proximal parts in a manner to prevent phase difference mutually therebetween by two vertical spaced-apart support shafts 66 and 67 provided parallelly between upper and lower support plates 64 and 65 and passing through the proximal parts of the arms 62 and 63. The upper and lower support plates 64 and 65 are rotatable about one, 66, of the support shafts. One end of a lever 69 pivoted at an intermediate point thereof on a shaft 68 is pin connected to a part of the lower support plate 65, as shown in FIG. 4. The other end of the lever 69 supports a cam follower 70, which is pressed against a cam 71 fixedly provided on the aforementioned cam shaft 18 of the driving system by a spring (not shown).

The cam 71 has a recess 71*a* and, when the cam follower 70 enters this recess 71*a*, causes the lever 69 to rotate the lower support plate 65 in the clockwise direction as viewed from above in FIG. 4. As a consequence, the crimping hooks 14, 14 advance to a position between the wrapping rollers 10 and 11 of the coin wrapping device 13 where the crimping hooks 14, 14 can engage respectively with the upwardly and downwardly projecting edges of the wrapping paper wrapped around a coin stack.

A recess 72 is formed at the lower proximal part of the above described upper arm 62 and is engaged by a roller 74 rotatably supported on one end of a lever 73 for raising and lowering the upper arm 62. A recess 75 is formed at the lower proximal part of the lower arm 63 and is engaged by a roller 74 rotatably supported on one end of a lever 76 for raising and lowering the lower arm 63. Thus, the upper and lower arms 62 and 63 supporting the crimping hooks 14, 14 are moved vertically in directions to separate from and approach each other by the pivotal rotations of the levers 73 and 76.

The lever 73 is coupled at an intermediate part thereof by a shaft 79 to an intermediate part of a driving lever 78 for driving the upper arm 62. The other end of the lever 76 for raising and lowering the lower arm 63 and one end of the driving lever 78 are pivotally supported on a setting shaft 80, and, at the same time, the other end of the lever 73 for raising and lowering the upper arm 62 is coupled by way of a pin connection 83 and a link 82 to a lever 81 fixed to the setting shaft 80.

Furthermore, the other end of the driving lever 78 and an intermediate part of the lever 76 for raising and lowering the lower arm 63 are respectively provided with cam followers 84 and 85, which are pressed by the forces of springs 89 and 90 against the upper and lower cam surfaces, respectively, of a cam 86 fixedly supported on the cam shaft 18 and operating to drive the crimping hooks 14, 14.

The setting shaft 80 is coupled to the aforementioned control transmitting shaft 57 by way of links 91, 92, and 93 for reversing the rotational direction, and the lever 73 for actuating the upper arm 62 is rotated in accordance with the angle of rotation of the aforementioned detection lever 58 transmitted through the lever 81 and the link 82. This lever 73 is thus swung through an angular displacement such that the roller 74 at its end is brought into the position corresponding to the paper width of the relevant wrapping paper roll 25 loaded on its loading platform 24.

The aforementioned rotating shaft 22 is driven in rotation by power produced by a motor 94 and transmitted through an endless belt 95, a pulley 96, and gears 97 and 98.

The embodiment of this invention of the above described structure is operated in the following manner.

First, on the wrapping roll loading platforms 24, 24, . . . of the wrapping paper storing device 20, rolls 25 of wrapping paper of paper widths corresponding respectively to these platforms are loaded. For this operation, the lock screws 33, 33 of the column 30 of each platform 24 are loosened, and the holding member 31 is left in its raised position. Next each roll 25 is fitted at its central hole 25*a* onto the support spindle 28 of the corresponding loading plate 26 thereby to load the roll 25 in upright state.

The holding member 31 is thereafter lowered until it rests on the upper flat face surface of the roll 25, and, with the holding member 31 in this state, the column 30 is fixed in position by tightening the lock screws 33, 33. The angular position of each arm 53 pin connected at its free end to the column 30 is thereby set, whereby the detection member 55 is also fixed in position. Therefore, the position of each detection member 55 is determined in conformance with the height of the corresponding paper roll 25, that is, the paper width.

When this setting procedure has been carried out for all loading platforms, 24, 24, . . . , and the loading platform 24 loaded with a roll 25 of the required paper width is brought into the paper feeding position (indicated by arrow A in FIG. 2), the roller 56 at the end of the detection member 55 of that loading platform 24 contacts a surface of the driven lever 58 and pushes this lever thereby to rotate the control transmitting shaft 57 through a specific angle. As a consequence of the rotation of this shaft 57, the setting shaft 80 rotates through a specific angle, and this rotation is transmitted through the lever 81 and the link 82 to vary the position of the pin connection 83 between the link 82 and the lever 73 for raising and lowering the upper arm 62.

Consequently, the lever 73 pivots about the shaft 79, and the roller at its end moves the upper support arm 62 upward or downward to a specific height thereby to set the upper crimping hook 14 at the proper position for the width of the wrapping paper to be fed.

In the case where another wrapping paper roll 25 is selected, also, the upper crimping hook 14 is set in the same manner at the proper height position for the width of the wrapping paper of that selected roll 25.

When, after this setting, a starting command is applied. The coins C are fed successively and in an orderly file from the coin feeding device 6 shown in FIG. 1 into the coin passage to be propelled by the coin propelling device 4 and counted by the counting mechanism 5. A specific number of coins thus counted for one wrapping batch are then introduced into the coin stacking cylinder 7 and stacked on the shutter plates 8, 8 in closed state at the bottom opening of the stacking cylinder 7.

When the cam shaft 18 is actuated at this time, the stacked coin supporting device 17 is raised by a cam on this cam shaft 18 to a position for receiving the coin stack. Immediately thereafter, the shutter mechanism 9 is operated by the action of a cam on the cam shaft 18 to open the shutter plates 8, 8, whereupon the coin stack is received by the stacked coin supporting device 17.

The supporting device 17 then descends and introduces the coin stack into the space between the wrapping rollers 10, 11, and 12 of the coin wrapping device 13, whereupon the wrapping rollers 10, 11, and 12 converge so as to contact the cylindrical surface of the coin stack and clamp the wrapping paper firmly. As a consequence, the wrapping paper is tensioned and pressed against the cutter 41 to be cut thereby to a predetermined length.

The leading end of the piece of paper thus cut is introduced between the wrapping rollers 10, 11 and 12 and the coin stack, whereupon the paper is wrapped around the cylindrical surface of the coin stack by the rotation thereof due to the rotational driving action of the wrapping rolls.

Upon completion of this wrapping step, the support plate 65 of the fold crimping device 15 is rotated clockwise as viewed from above in FIG. 4 by the cam 71 on the cam shaft 18, whereby the upper and lower crimping hooks 14, 14 are advanced between the wrapping rollers 10 and 11 to confront the upper and lower projecting edges of the wrapping paper thus wrapped around the coin stack.

Immediately thereafter, the cam followers 84 and 85 move into the respective recesses in the upper and lower cam surfaces 87 and 88 of the cam 86 on the cam shaft 18 for driving the crimping hooks since the springs 89 and 90, respectively acting the ends of the driving lever 78 and the lever 76 for actuating the lower arm, maintain the cam followers 84 and 85 in intimate and continual contact with their respective cam surfaces 87 and 88. At this time, the movement of the driving lever 78 is transmitted by way of the shaft 79 to the lever 83 for actuating the upper arm, whereby this lever 73 is swung downward about the pin 83 and lowers the cam 62 for supporting the upper crimping hook.

As a result of the above described operation, the upper and lower arms 62 and 63 for supporting the upper and lower crimping hooks are moved in mutually approaching directions, and the crimping hooks 14, 14 mounted on the extremities of these arms 62 and 63 respectively engage in a straddling manner the extreme edges of the wrapping paper projecting upward and downward beyond the ends of the coin stack. Consequently, and as a result of the rotation of the wrapping paper, each of the crimping hooks 14, 14 progressively folds the projecting paper edge radially inward and thus fold crimps the paper edge into a firm bead-like rim, which cannot be easily unraveled.

When the fold crimping step is completed, the upper and lower cam followers 84 and 85 move onto respective high parts of the upper and lower cam surfaces 87 and 88 of the cam 86 thereby to actuate the driving lever 78 and the lever 76 for actuating the lower arm in mutually separating directions, whereby the upper and lower arms 62 and 63 supporting the upper and lower crimping hooks 14, 14 are returned to their initial positions.

At this time, a high part of the cam 71 on the cam shaft 18 actuates the cam follower 70 thereby to rotate the support plate 65 in the counterclockwise direction as viewed from above in FIG. 4. Accordingly, the upper and lower arms 62 and 63 are swung about the support shafts 66 thereby to retract the crimping hooks out of the coin wrapping device 13.

In concert with this action, the stacked coin supporting device 17 descends to its lowermost position and then, retracting by swinging out of the coin wrapping device 13, drops the paper wrapped coin stack into the dispensing chute 16.

In accordance with this invention, as described above, when a wrapping paper roll loading platform loaded with wrapping paper corresponding to a coin stack to be wrapped is selectively moved into the paper feeding position, the operational position of the upper crimping hook is automatically adjusted and set by a detection member whose position is determined in conformance with the width of that wrapping paper. Accordingly, when the kind of the coins to be wrapped is changed, there is no necessity of a separate step of setting the position of the upper crimping hook in conformance with the width of the wrapping paper for wrapping coins of the new kind. Moreover, since there is no necessity of carrying out this setting with force from the control manipulation system for setting the machine for the kind of coin, the manipulating force required to actuate the handle or knob for setting for the kind of coin is greatly reduced, whereby the manipulation for controlling the coin wrapping machine is remarkably facilitated.

It should be understood, of course, that the foregoing disclosure relates to only a preferred embodiment of the invention and that it is intended to cover all changes and modifications of the example of the invention herein chosen for the purposes of the disclosure, which do not constitute departures from the spirit and scope of the invention. For example, the mechanism for adjusting and setting the position of the upper crimping hook including the structure of the fold crimping device 15 for actuating the crimping hooks is not intended to be limited to that of the example illustrated in FIG. 4 but may assume any form provided that it is capable of educing displacements of the detection member 55 or other equivalent means and setting the position of the upper crimping hook in conformance with the displacements.

Furthermore, while the invention has been described above with respect to an example wherein only the upper crimping hook is adjustably moved and set in conformance with the height (width) of the wrapping paper roll, it is possible to provide a mechanism whereby both the upper and lower crimping hooks are adjusted and set depending on the necessity. In addition, the invention can be applied, for course, to a coin wrapping machine in which the edge crimping process is carried out in left and right directions instead of in the up and down directions as in the above described example.

We claim:

1. In a coin wrapping machine of the type having coin wrapping means for wrapping a piece of wrapping paper around the cylindrical surface of each of successively arriving coin stacks each of a specific number of coins, the wrapping paper having a width greater than the length of the coin stack whereby lateral edges of the paper project outwardly beyond the ends of the coin stack, an edge fold crimping device including crimping hooks for fold crimping said projecting edges of the wrapping paper thereby to form a wrapped coin stack, and a wrapping paper storing device having a plurality of paper roll loading platforms for supporting thereon respective rolls of wrapping paper of respectively different widths corresponding to different heights of coin stacks and moving any of the platforms to a paper feeding position for unwinding and feeding the paper thereon to said coin wrapping means, a device for adjustably setting the operational position of at least one of the crimping hooks, said device comprising detection means for detecting the height of the paper roll on each loading platform, said detection means including a detection member undergoing a displacement in conformance with said height as detected by said detection mechanism, and a setting mechanism having a driven member engaged and driven by said detection member of a loading platform selected and moved to said paper feeding position thereby to set the operational position of said at least one crimping hook in conformance with the width of the wrapping paper on said loading platform.

* * * * *